United States Patent [19]

Brudermann et al.

[11] Patent Number: 4,732,426

[45] Date of Patent: Mar. 22, 1988

[54] SEATING-SYSTEM FOR FOLDING WHEELCHAIRS

[75] Inventors: Uwe Brudermann, Heikendorf; Ruth Kruse, Laboe; Peter Mackert, Bellin, all of Fed. Rep. of Germany

[73] Assignee: Ortopedia GmbH, Kiel, Fed. Rep. of Germany

[21] Appl. No.: 795,995

[22] Filed: Nov. 7, 1985

[30] Foreign Application Priority Data

Nov. 7, 1984 [DE] Fed. Rep. of Germany ..... 3440671

[51] Int. Cl.[4] ..... A47C 7/02

[52] U.S. Cl. ..... 297/452; 297/457; 297/DIG. 4

[58] Field of Search ..... 297/457, 458, 459, 460, 297/453, DIG. 4, DIG. 2, 452; 5/448

[56] References Cited

U.S. PATENT DOCUMENTS

| | | | |
|---|---|---|---|
| 3,028,201 | 4/1962 | Heckethorn | 297/453 |
| 4,435,015 | 3/1984 | Trotiman et al. | 297/453 |
| 4,493,488 | 1/1985 | Panaia et al. | 297/42 |
| 4,579,390 | 4/1986 | Guille | 297/457 |

*Primary Examiner*—James T. McCall

*Attorney, Agent, or Firm*—John P. White

[57] ABSTRACT

The present invention relates to a seat structure for collapsible (foldable) invalid chairs provided with a flexible seat and/or back covering, comprising an upholstery material (3) and a covering material (4) at least partially enclosing said upholstery material. The covering material (4) is provided with ultrafine perforations, and an open-pore foam material shaped as a molded part is used for the upholstery material.

11 Claims, 12 Drawing Figures

SEATING-SYSTEM FOR FOLDING WHEELCHAIRS

Figure 1:
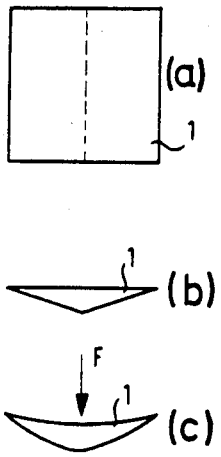
PRIOR ART FIG.1

The present invention relates to a seat structure according to the preamble of patent claim 1.

Collapsible (or foldable) invalid chairs have been in world-wide use for more than 50 years, because they offer essential advantages to a disabled person: These invalid chairs are of low weight, short in overall length and, owing to their collapsibility, also of small stowage volume so that they may be easily transported to a desired place. Further, collapsible invalid chairs are characterized by a maximum degree of weather resistance and relatively low costs of manufacture.

However, these numerous advantages are opposed by severe drawbacks:

The small stowage volume is a result of the collapsibility only, and the low manufacturing costs and the low weight can be obtained only by a flexible seat and back covering, because in any other structures providing for collapsibility, such as by using hinges, the manufacturing costs and the weight would increase undesirably.

Thus, in order to provide for collapsibility at low weight and low manufacturing costs, flexible seat and back coverings are used, for which artificial leather is used preferably.

Artificial leather is weatherproof, washable and compatible to incontinence; therefore, a collapsible invalid chair having an artificial leather covering for seat and back portions is beneficial.

However, a flexible seat and back covering, when subjected to load, sags necessarily, this being undesirable for ergonomical and medical reasons: The risk of decubitus and stoop increases, this being extremely inconvenient to the disabled person and constituting a considerable drawback particularly in the use of the collapsible invalid chair for long periods.

Still further, the advantage of the washability of the artificial leather frequently used for the seat and back coverings, the weather resistance thereof and its compatibility to incontinence is accompanied by the drawback of the impermeability to (water) steam which is generally responsible for the poor "seating climate" of conventional invalid chairs, which greatly increases the risk of decubitus.

Now, it could be thought of using for a collapsible invalid chair anatomically shaped seat and back shells or the like, thereby to prevent the "hammock effect" of a covering and mitigate the risk of decubitus and stoop. However, a seat or back shell of this kind can be realized—if the collapsible invalid chair is to retain its collapsibility—by expensive mechanical constructions only, which require hinges of a special configuration. This fact raises the manufacturing costs, and the invalid chair is deprived of its low weight.

Further, it could be conceived to subject the covering material to the ultrafine perforation treatment being known per se from European Pat. No. 00 07 488 or U.S. Pat. No. 4,278,871, respectively, and at the same time to use a steam permeable upholstering material so as to improve the "seat-climatic" conditions. However, such a seat and back covering would improve solely the "seat climate", and thereby eliminate only a part of the causes of decubitus.

It is therefore the object of the present invention to provide a seat structure for a collapsible invalid chair of the type mentioned above, which seat structure is characterized by high flexibility, ready collapsibility, low weight, optimum support in the seat and back regions of the disabled person in accordance with anatomical aspects, satisfactory ventilation and steam permeability through the seat assembly and low manufacturing costs, and which is compatible with existing collapsible invalid chairs and lends itself to standardization.

In a seat structure of the type as outlined at the beginning, according to the invention this object is solved by the features defined in the characterizing portion of patent claim 1.

Artificial leather may be used for the covering material, which has been provided with ultrafine perforations by the method described in European Pat. No. 00 07 488 or U.S. Pat. No. 4,278,871 or in any other customary manner.

The covering material may be impermeable to water or—for use with collapsible invalid chairs for indoor use—even permeable to water.

In addition to artificial leather, it is also possible to use as the covering material, for example, a suitably manufactured or treated (impregnated) textile fabric; and for invalid chairs for indoor use there may be used instead—while dispensing with the weatherproofness—a different kind of steam permeable textile fabric.

Still further, in order to not affect the effective steam permeability of the covering material, there may be used for the upholstery material, a material likewise permeable to steam, which must have suitable spring-back resilience to provide for the necessary uniformity of the seating pressure distribution, and which, when suitably shaped as a molded or shaped part, offers the requisite anatomically proper support. A suitable material of this type is, for example, an open-pore PUR foam of expedient hardness adjustment. However, it is also possible to employ other suitable, steam permeable foam materials or non-foam materials which exhibit the spring-back resilience characteristics required to provide cushioning properties, and which are permeable to steam at the same time.

It is of particular importance that the covering for the seat and/or back portions of the collapsible invalid chair is provided with ultrafine perforations. Such ultrafine perforations ensure adequate ventilation and steam permeability, thereby to provide excellent "seat-climatic" conditions which respect to temperature and relative humidity on the body surface of the disabled person. The manufacturing costs for the covering (e.g. artificial leather) are relatively low since the ultrafine perforations may be formed in the covering material in an easy manner (as explained above).

Of further importance to the seat structure according to the invention is that open-pore foam materials are used. Such open-pore foam materials are likewise permeable to steam and air—same as e.g. the artificial leather covering provided with ultrafine perforations—, whereby the seating comfort for the disabled person is further improved.

Finally, the upholstery material of the seat structure according to the invention is formed as a molded or shaped part, such that the seat portion and/or back portion, in consideration of the deformation under the load of the disabled person's body, assumes a surface configuration with respect to said body, which provides for favorable pressure distribution.

Expediently, the upholstery material molded part is configured such that the development of the surface of the molded part for seat and/or back portion corresponds approximately to the conventional blanks of seat and/or back coverings of collapsible invalid chairs equipped with flexible seat and/or backcovering. In this manner, it may be ensured that the coverings for the seat portion and the back portion can receive or enclose the upholstery material molded parts almost without creating folds, and this feature is not only decisive to the optical appearance of the invalid chairs, but additionally also contributes to the uniform seating pressure distribution.

In addition, the upholstery material molded parts may be configured such that, when the molded parts are cut out from the respective semiproducts (foam material), the waste of material is extremely low and the utilization of material is particularly favorable.

Accordingly, the present invention for the first time provides for a collapsible invalid chair a particularly advantageous seat structure which is flexible, which permits the invalid chair to be collapsed without requiring expensive mechanical structures, which at most insignificantly increases the weight of the invalid chair, and which provides for support of the seat and back regions of a disabled person under anatomical aspects. Also, adequate ventilation and steam permeability through the upholstery material is secured by the open-pore foam material and the ultrafine perforations of the covering material. This results in a highly favorable "seating climate" to greatly reduce the risk of decubitus.

The manufacturing costs for the seat structure according to the invention are increased to an insignificant degree only, because—as explained above—the artificial leather covering can be perforated easily, while the foam material does not require any special treatment.

Figure 2:
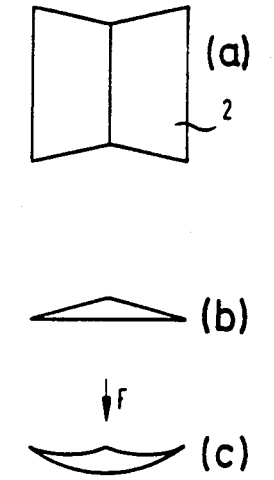
Figure 2:
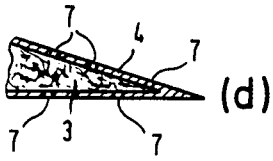
Figure 3:
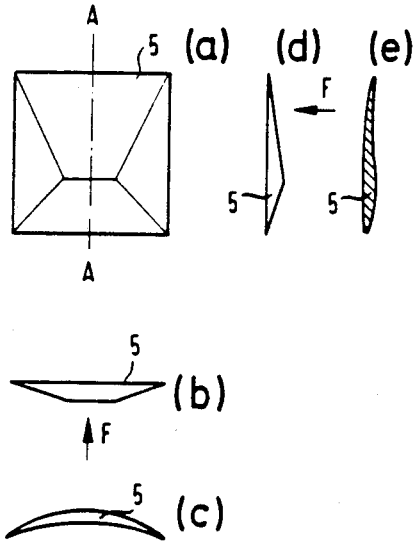

Below, the present invention is described in greater detail with reference to the drawing, wherein:

FIG. 1 shows a conventional (seat) cushion, namely in plan view in FIG. 1*a*, in front elevational view and in an unloaded state in FIG. 1*b*, and in front elevational view and in a loaded state in FIG. 1*c*;

FIG. 2 shows a seat portion of the seat structure according to the present invention, namely in plan view in FIG. 2*a*, in front elevational view and in a unloaded state in FIG. 2*b*, and in front elevational view and in a loaded state in FIG. 2*c*, while FIG. 2*d* is an enlarged view of the seat portion of FIG. 2*b*; and FIG. 3 shows a back portion of the seat structure according to the present invention, namely in front elevational view in FIG. 3*a*, in plan view and in an unloaded state in FIG. 3*b*, in plan view and in a loaded state in FIG. 3*c*, and in side elevational view and in an unloaded state in FIG. 3*d*, while FIG. 3*e* is a sectional view along lines A—A in FIG. 3*a* showing the back portion in a loaded state.

The conventional (seat) cushion shown in FIG. 1 has a triangular cross-section (compare FIG. 1*b*), with the (upper) surface of the seat being substantially flat. The reinforced region is disposed opposite to the surface of the seat, whereby the latter assumes a slightly concave configuration under a load (compare arrow F in FIG. 1*c*).

The (seat) cushion shown in FIG. 1 is presently available as separate item only. When a (seat) cushion of this type is placed upon the seat covering of a collapsible invalid chair, the cushion is liable to slip, whereby its advantageous properties are impaired. Also, there exists the risk that a (seat) cushion of this kind, used as a separate item, becomes lost.

On the other hand, FIG. 2 shows a seat portion for the seat structure according to the invention. This seat portion does not constitute a (seat) cushion to be placed onto the seat covering of a collapsible invalid chair. Rather, the seat portion 2 has its edges joined to the collapsible invalid chair. In contrast with the (seat) cushion shown in FIG. 1, the seat portion 2 is shaped to be convex in the direction of a force F exerted thereon (see FIGS. 2*b*, 2*c*), and it is provided with concave front and rear edges (see FIG. 2*a*), whereby a configuration is obtained which is particularly favorable in anatomical respects.

FIG. 2*d* shows an enlarged sectional view of the seat portion according to FIG. 2*b*. An upholstery material 3 of open-pore PUR foam material is enclosed by an artificial leather covering 4 provided with ultrafine perforations (7), with the development of the surface of the molded part, consisting of the upholstery material, corresponding to the unvaried artificial leather covering 4.

Finally, FIG. 3 illustrates a back portion 5 of the seat assembly according to the invention. Like the seat portion 2, this back portion 5 is shaped so as to have a surface being convex in the direction of the force F exerted thereon (compare FIGS. 3*b* and 3*c*), with the cross-section of the back portion having a trapezoidal outline in horizontal direction (FIG. 3*b*) and a triangular outline in vertical direction (FIG. 3*d*); thus, an anatomically particularly favorable configuration results when a load acts upon the back portion. As can be seen especially from FIGS. 3*c* and 3*e*, the back portion 5 is capable of properly conforming itself to the anatomy of a human back.

What is claimed is:

1. A seat structure comprising a portion useful as a seat portion, a back portion, or both for collapsible invalid chairs having flexible seat or back coverings of an upholstery material (3) and a covering material (4) at least partially enclosing the upholstery material, characterized in that the upholstery material (3) comprises a spring-back resilient and steam permeable material and is shaped as a molded part providing for favorable seating pressure distribution; that the covering material (4) is provided with ultrafine perforations (7) rendering the covering material permeable to steam; that the seat structure allows for the collapsibility of the collapsible invalid chair owing to the flexibility of the materials used and the configuration of the molded part; that the development of the surface of the molded part for seat, back, or both portions corresponds approximately to the conventional blank of seat or back coverings of collapsible invalid chairs provided with a flexible seat, back, or both covering, and that the molded parts, in their unloaded state, are shaped to be convex in the direction of the load.

2. A seat structure comprising a portion useful as a seat portion, a back portion, or both for collapsible invalid chairs having flexible seat or back coverings of an upholstery material (3) and a covering material (4) at least partially enclosing the upholstery material, characterized in that the upholstery material (3) comprises a spring-back resilient and steam permeable material and is shaped as a molded part providing for favorable seating pressure distribution; that the covering material (4) is provided with ultrafine perforations (7) rendering the covering material permeable to steam; that the seat structure allows for the collapsibility of the collapsible invalid chair owing to the flexibility of the materials used and the configuration of the molded part; that the development of the surface of the molded part for seat, back, or both portions corresponds approximately to the conventional blank of seat or back coverings of collapsible invalid chairs provided with a flexible seat, back, or both covering, and the front edge and the rear edge of the seat portion (2) run inwardly in a concave form from the lateral edges of the seat portion (2) when seen in plan view.

3. The seat structure according to claim 1, characterized in that the back portion (5) has an approximately trapezoidal cross-section in horizontal direction, and an approximately triangular cross-section in vertical direction.

4. The seat structure according to any one of claims 1 to 3, characterized in that the covering material (4) consists of a suitable produced or processed artificial leather.

5. The seat structure according to any one of claims 1 to 3, characterized in that the covering material consists of artificial leather having been provided with ultrafine perforation in a conventional manner.

6. The seat structure according to any one of claims 1 to 3, characterized in that the covering material comprises a suitably produced and/or treated (processed) textile fabric.

7. The seat structure according to claims 1 or 2, characterized in that the covering material (4) is impermeable to water.

8. The seat structure according to claim 6, characterized in that for collapsible invalid chairs for indoor use, the covering material (4) is permeable to water.

9. The seat structure according to claims 1 or 2, characterized in that the upholstery material (3) comprises open-pore polyurethane foam material.

10. The seat structure according to claims 1 or 2, characterized in that the upholstery material comprises a suitable steam permeable foam material.

11. The seat structure according to claims 1 or 2, characterized in that the upholstery material (3) is formed of non-foam material which, however, exhibits the spring-back resilience characteristics required for cushioning properties, while being permeable to steam at the same time.

* * * * *